US011828276B2

(12) United States Patent
Wohlhauser

(10) Patent No.: US 11,828,276 B2
(45) Date of Patent: Nov. 28, 2023

(54) ADJUSTING DEVICE FOR AN AXIAL PISTON MACHINE

(71) Applicant: Liebherr Machines Bulle SA, Bulle (CH)

(72) Inventor: Patrick Wohlhauser, Giffers (CH)

(73) Assignee: LIEBHERR MACHINES BULLE SA, Bulle (CH)

( * ) Notice: Subject to any disclaimer, the term of this patent is extended or adjusted under 35 U.S.C. 154(b) by 335 days.

(21) Appl. No.: 16/189,094

(22) Filed: Nov. 13, 2018

(65) Prior Publication Data

US 2019/0145389 A1 May 16, 2019

(30) Foreign Application Priority Data

Nov. 11, 2017 (CH) ..... 01365/17

(51) Int. Cl.

| | |
|---|---|
| ***F04B 1/324*** | (2020.01) |
| ***F04B 1/146*** | (2020.01) |
| ***F04B 49/00*** | (2006.01) |
| ***F03C 1/06*** | (2006.01) |
| ***F03C 1/40*** | (2006.01) |
| ***F04B 1/2078*** | (2020.01) |
| ***F04B 1/295*** | (2020.01) |

(Continued)

(52) U.S. Cl.

CPC ..... *F04B 1/324* (2013.01); *F03C 1/0602* (2013.01); *F03C 1/0686* (2013.01); *F04B 1/122* (2013.01); *F04B 1/146* (2013.01); *F04B 1/2078* (2013.01); *F04B 1/26* (2013.01); *F04B 1/295* (2013.01); *F04B 1/326* (2013.01); *F04B 49/002* (2013.01); *F01B 3/0044* (2013.01); *F03C 1/0631* (2013.01); *F04B 49/08* (2013.01)

(58) Field of Classification Search

CPC ..... F04B 1/324; F04B 1/2078; F04B 1/295; F04B 1/26; F04B 1/326; F04B 1/122; F04B 1/146; F04B 49/002; F04B 49/08; F03C 1/0602; F03C 1/0686; F03C 1/0631; F01B 3/0044

See application file for complete search history.

(56) References Cited

U.S. PATENT DOCUMENTS

| | | | | |
|---|---|---|---|---|
| 4,281,676 | A | 8/1981 | Morris | |
| 6,725,658 | B1 * | 4/2004 | Lemmen | F04B 1/324 60/443 |

(Continued)

FOREIGN PATENT DOCUMENTS

| | | | |
|---|---|---|---|
| CN | 106351813 | A | 1/2017 |
| DE | 3212429 | A1 | 10/1983 |

(Continued)

*Primary Examiner* — Charles G Freay
*Assistant Examiner* — Lilya Pekarskaya
(74) *Attorney, Agent, or Firm* — McCoy Russell LLP

(57) ABSTRACT

The present disclosure relates to an adjusting device for adjusting the swash plate of an axial piston machine comprising an adjusting piston, which is connected to the swash plate of the axial piston machine via an adjusting lever, and a regulator for adjusting the adjusting pressure acting on the adjusting piston in dependence on a control force acting on a control piston of the regulator, wherein the adjusting piston is connected to the control piston via a feedback spring. In accordance with the present disclosure the feedback spring is at least partly received in a pot-shaped recess of the control piston.

18 Claims, 10 Drawing Sheets

(51) Int. Cl.

| | |
|---|---|
| ***F04B 1/26*** | (2006.01) |
| ***F04B 1/326*** | (2020.01) |
| ***F04B 1/122*** | (2020.01) |
| *F01B 3/00* | (2006.01) |
| *F04B 49/08* | (2006.01) |

(56) References Cited

U.S. PATENT DOCUMENTS

| | | | | |
|---|---|---|---|---|
| 6,838,965 | B1 * | 1/2005 | Von Gaisberg | H01F 7/13 335/274 |
| 9,280,160 | B2 * | 3/2016 | Diebold | F04B 1/324 |
| 9,541,072 | B2 * | 1/2017 | Howind | F04B 1/32 |
| 2014/0033911 | A1 | 2/2014 | Rudik et al. | |
| 2014/0147298 | A1 * | 5/2014 | Diebold | F03C 1/0686 417/222.1 |
| 2017/0306946 | A1 * | 10/2017 | Frick | F04B 1/295 |
| 2020/0256326 | A1 * | 8/2020 | Kharpas | F04B 49/002 |

FOREIGN PATENT DOCUMENTS

| | | | | |
|---|---|---|---|---|
| DE | 3330402 | A1 | 2/1984 | |
| DE | 8530800 | U1 | 2/1986 | |
| DE | 2457301 | C2 | 10/1986 | |
| DE | 10001826 | C1 | 9/2001 | |
| DE | 19842029 | B4 | 2/2005 | |
| DE | 102004014293 | A1 | 10/2005 | |
| DE | 60301986 | T2 | 7/2006 | |
| DE | 102012214372 | A1 | 9/2013 | |
| DE | 102012015503 | A1 | 2/2014 | |
| EP | 1220990 | B1 | 11/2005 | |
| WO | WO-2017083839 | A1 * | 5/2017 | F04B 1/2078 |

* cited by examiner

ADJUSTING DEVICE FOR AN AXIAL PISTON MACHINE

CROSS REFERENCE TO RELATED APPLICATION

This application claims priority to Swiss Patent Application No. 01365/17 filed Nov. 11, 2017, entitled "Adjusting Device For An Axial Piston Machine," the entire contents of which is hereby incorporated by reference in its entirety for all purposes.

TECHNICAL FIELD

This present disclosure relates to an adjusting device for adjusting the swash plate of an axial piston machine.

BACKGROUND AND SUMMARY

The design of an axial piston machine in a swash plate construction is known for example from DE 10 2012 015 503 A1. In such hydrostatic machines the delivery/absorption volume is adjustable by pivoting a swash plate against which a plurality of pistons rest that are guided in a cylinder drum. The pivoting of the swash plate is affected via a corresponding adjusting device. The requirements for high efficiencies and high power densities imposed on axial piston machines require the adjustability of the swash plate over an angular range as large as possible. This means that the adjusting piston of the adjusting device has a large stroke range.

From EP 1 220 990 B1 there is known an adjusting device for adjusting the swash plate of an axial piston machine, in which the adjusting piston is adjustable over a large stroke range. Via a feedback spring, the adjusting piston which is connected to the swash plate of the axial piston machine via an adjusting lever is connected to the control piston of that regulator which serves for adjusting the adjusting pressure acting on the adjusting piston in dependence on a control force acting on the control piston of the regulator. An adjusting device of simple and robust design thereby is created to adjust the swash plate of an axial piston machine in a swash plate construction, in which the adjustment path of the adjusting piston exerts the desired retroactive effect on the position of the control piston. As the feedback spring follows the comparatively long adjustment range of the adjusting piston, the same has a rather great length. This leads to the fact that the entire regulator also has a large length dimension.

It therefore is the object of the present disclosure to construct an adjusting device for adjusting the swash plate of an axial piston machine which is compact, wherein the overall length is reduced.

In accordance with the present disclosure, this object is solved by an adjusting device for adjusting the swash plate of an axial piston machine includes the combination of an adjusting piston that is connected to the swash plate of the axial piston machine via an adjusting lever, and a regulator for adjusting the adjusting pressure acting on the adjusting piston in dependence on a control force acting on a control piston of the regulator, wherein the adjusting piston is connected to the control piston via a feedback spring. The feedback spring according to the present disclosure is at least partly received in a pot-shaped recess of the control piston. Thereby, a compact arrangement is achieved.

In contrast to the already known solution from EP 1 220 990 B1, in which the feedback spring with some windings could dip into the partly hollow-drilled adjusting piston, the formation of the pot-shaped recess of the control piston according to the present disclosure provides for a much shorter overall length. The control piston is constructed much longer than the adjusting piston due to functional reasons. The pot-shaped recess of the control piston can be designed so long that substantially the entire feedback spring can be received in the same in the compressed condition.

Accordingly, the control piston is arranged in a control piston receiving bore and the adjusting piston is arranged in an adjusting piston receiving bore, wherein the control piston receiving bore and the adjusting piston receiving bore merge into each other, in one embodiment. The adjusting piston receiving bore has a larger diameter than the control piston receiving bore. The adjusting piston receiving bore and the control piston receiving bore thus form a shoulder in the adjusting device housing so that during an assembly the adjusting piston is inserted into the adjusting piston receiving bore from one side, while the control piston is inserted into the control piston receiving bore from the other side.

According to one embodiment of the present disclosure the control piston receiving bore and the adjusting piston receiving bore are coaxially arranged in the adjusting device housing. This coaxial arrangement leads to the control piston being guided in the control piston receiving bore and the adjusting piston arranged in the adjusting piston receiving bore also are arranged on one axis, wherein they are axially offset on the axis. During the assembly, the control piston and the adjusting piston are inserted from one side into a uniform bore with a nominal diameter. Due to the inventive stepped design of the receiving bores with different diameters, the housing can be dimensioned smaller in the region of the control piston arranged in the smaller control piston receiving bore.

The coaxial alignment of control piston and adjusting piston corresponding to the aforementioned embodiment however is disadvantageous, as the adjusting piston connected to the swash plate of the axial piston machine via an adjusting lever compensates a transverse force introduced via the adjusting lever, which leads to a non-uniform action on the adjusting piston in the adjusting piston receiving bore. As a compensation of this transverse force the present disclosure provides two alternative design variants.

The first design variant consists in that the control piston receiving bore and the adjusting piston receiving bore are aligned at an angle to each other. The angle is chosen such that the transverse force applied onto the adjusting piston at one end via the adjusting lever is compensated via the correspondingly angled control piston and the spring guided by the same.

An alternative design variant consists in that the control piston receiving bore and the adjusting piston receiving bore are arranged offset from each other such that the corresponding transverse force likewise is compensated.

According to another aspect of the present disclosure the pot-shaped recess not only receives the feedback spring, but at the same time is filled with hydraulic oil at adjusting pressure level. The hydraulic oil gets into the pot-shaped recess of the control piston via corresponding bores in the side wall. The circumferentially arranged adjusting pressure bores can be connected to each other via a groove provided in the side wall of the pot-shaped recess. The oil connection between the cavity in the control piston and in the adjusting cylinder is effected in an axial direction. To avoid that in the regulator the position of the control piston is influenced by the adjusting pressure, a compensation is created. For this purpose an additional oil connection is created, by which the oil under the adjusting pressure also reaches the front side of the control piston facing away from the spring. For this purpose an axial bore is provided towards the side of the control piston opposite the pot-shaped recess.

According to another embodiment of the present disclosure the control piston is stepped on the outside and is mounted in the control piston receiving bore via a ring in its portion close to the end on the side opposite the bottom of the control piston. Via this ring, both cross-sectional surfaces of the control piston, which each are urged in opposite directions by the adjusting pressure, have the same size.

According to another embodiment of the present disclosure a tappet is guided through the control piston proceeding from the adjusting piston, wherein at the free end of the tappet a spring plate is arranged and wherein the feedback spring is supported on the spring plate and on the bottom of the pot-shaped recess of the control piston. This type of construction is a power regulator.

In accordance with the present disclosure, such power regulators and also volumetric flow regulators can be used as regulators.

According to another aspect of the present disclosure, which is employed in power regulators, the feedback spring has a non-linear spring characteristic. There is used a one-part spring with a non-linear spring characteristic. It is advantageous when the feedback spring has a progressively rising force-spring travel characteristic curve. Such a spring characteristic provides for a simple construction of a power regulator, in which the control piston and the adjusting piston are non-positively connected via such a common spring. Via a corresponding spring characteristic a regulator characteristic curve can be generated, which comes very close to a mathematically exact hyperbola (pHD*Q=constant).

Further features, details and advantages will be explained in detail with reference to the exemplary embodiments illustrated in the Figures.

DETAILED DESCRIPTION OF THE FIGURES

The adjusting device described below serves for adjusting the swash plate of an axial piston machine. The construction of a corresponding axial piston machine is known for example from EP 1 220 990 B1. With respect to the constructive details reference therefore is made to the disclosure presented there.

Figure 1A:
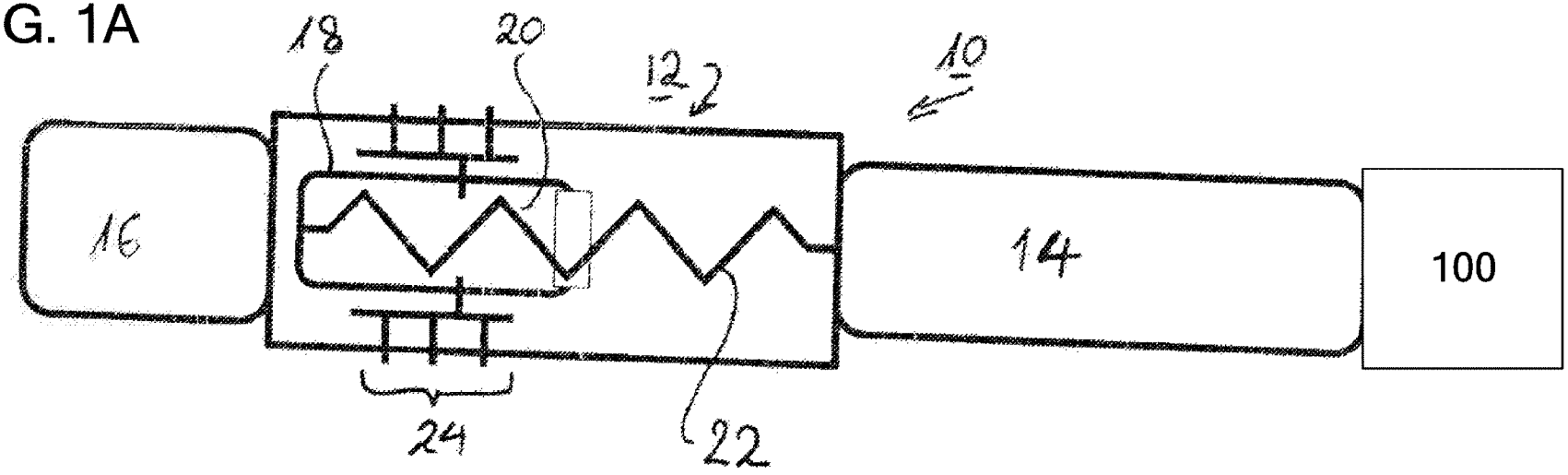
FIGS. 1A and, 1B show the schematic representation of a volumetric flow regulator (FIG. 1A) and a power regulator (FIG. 1B).
Figure 1B:
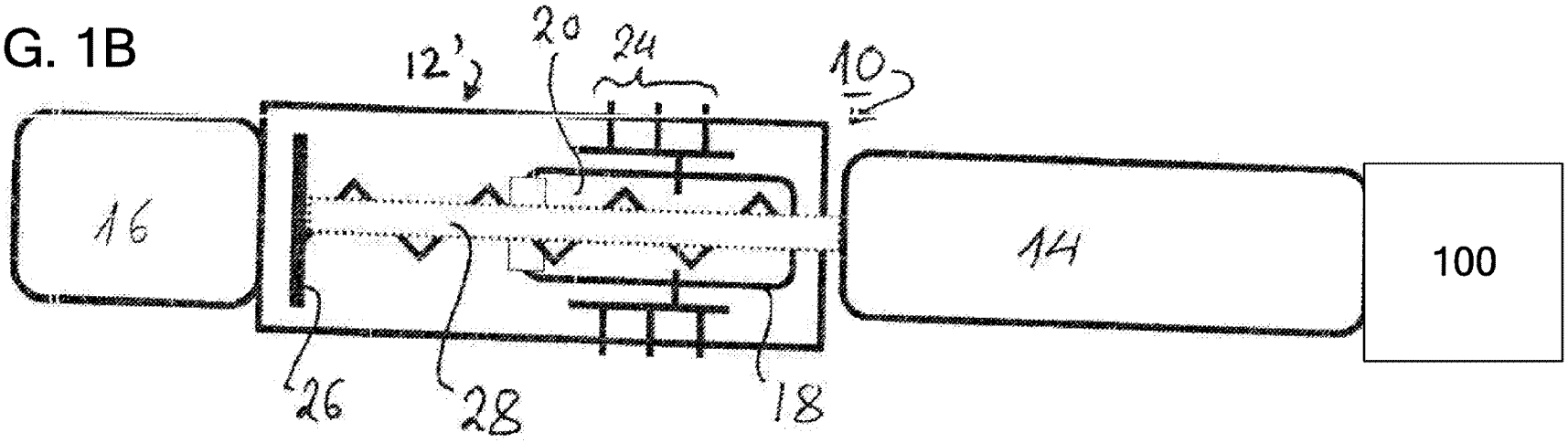

The subject-matter of the present disclosure is an adjusting device by means of which the adjusting piston for adjusting the swash plate is adjustable over a large stroke range. FIGS. 1A and 1B schematically show the construction of the adjusting device in two design variants. FIG. 1A represents an adjusting device 10 that comprises a volumetric flow regulator 12. The volumetric flow regulator 12 is adjoined by the only purely schematically represented adjusting piston 14 with connected adjusting lever 36. On the opposite side a closure and adjusting unit 16 is arranged. The volumetric flow regulator 12 substantially includes a control piston 18 that has a pot-shaped recess 20. Into the pot-shaped recess 20 of the control piston 18 a feedback spring 22 protrudes, which connects the control piston 18 to the adjusting piston 14 shown here only schematically. The adjusting piston 14 connected to the swash plate of the axial pistion machine 100. Reference numeral 24 designates the control unit 24 for the control piston 18, which represents the hydraulic ports for high pressure, tank recirculation and regulating pressure as well as the adjusting pressure bore.

FIG. 1B shows a corresponding adjusting device 10 with a power regulator 12'. On the one side, there is likewise arranged a closure and adjusting unit 16. The control piston 18 here is also formed with a pot-shaped recess 20, wherein with respect to its pot shape it is received in the corresponding control piston receiving bore 34 rotated by 180 degrees with respect to the volumetric flow regulator. In the power regulator 12' there is also provided a feedback spring 22 that dips into the pot-shaped recess 20 of the control piston 18. This spring 22, however, here on the one hand is supported on the bottom of the pot-shaped recess 20 and on the other hand on a spring plate 26 that via a tappet 28 is connected to the adjusting piston 14 and thus to the adjusting lever 36 adjoining the same. The adjusting piston 14 connected to the swash plate of the axial pistion machine 100.

Figure 2:
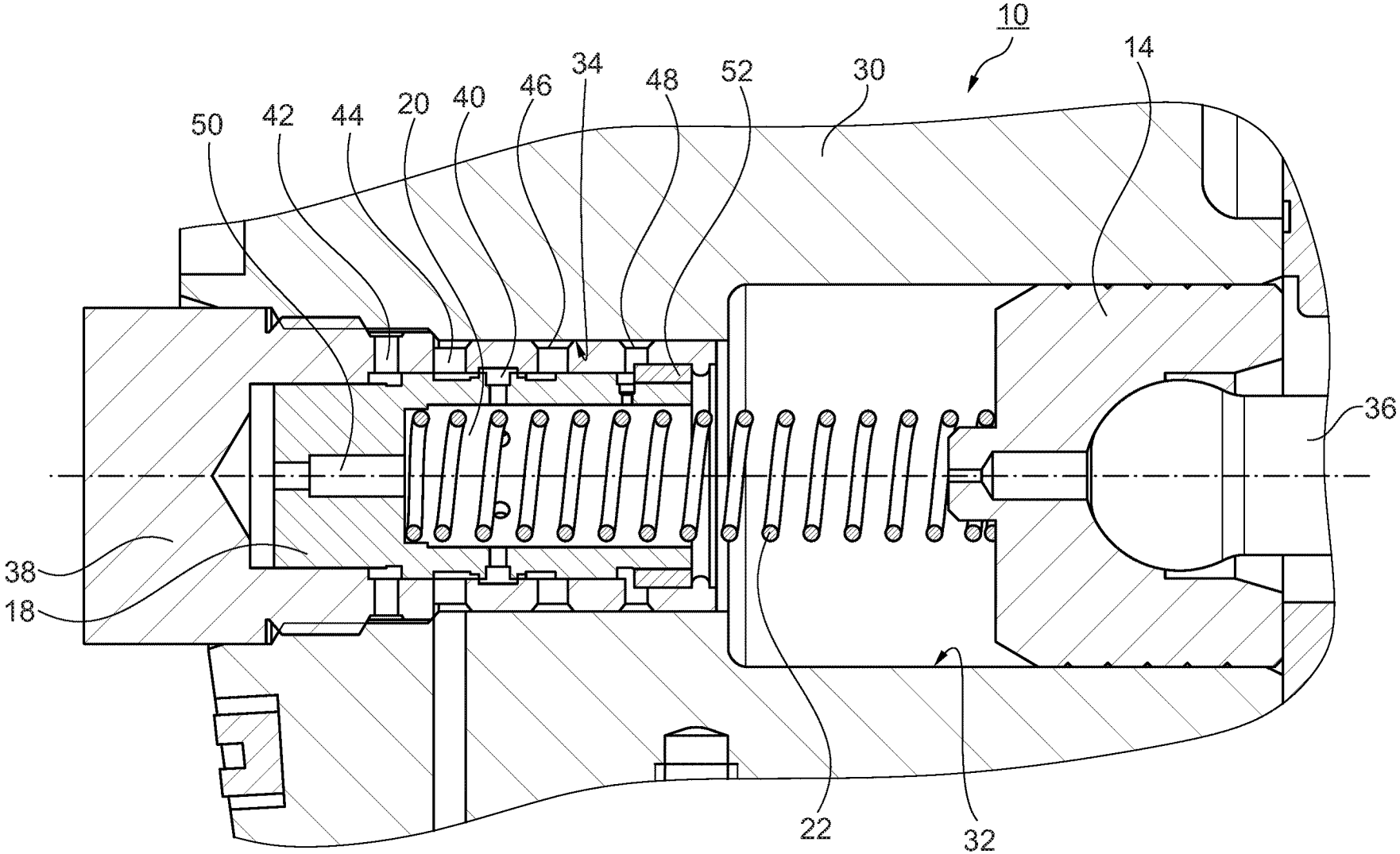
FIG. 2 shows a sectional representation through a part of an adjusting device according to a first embodiment of the present disclosure in a first working position.
Figure 3:
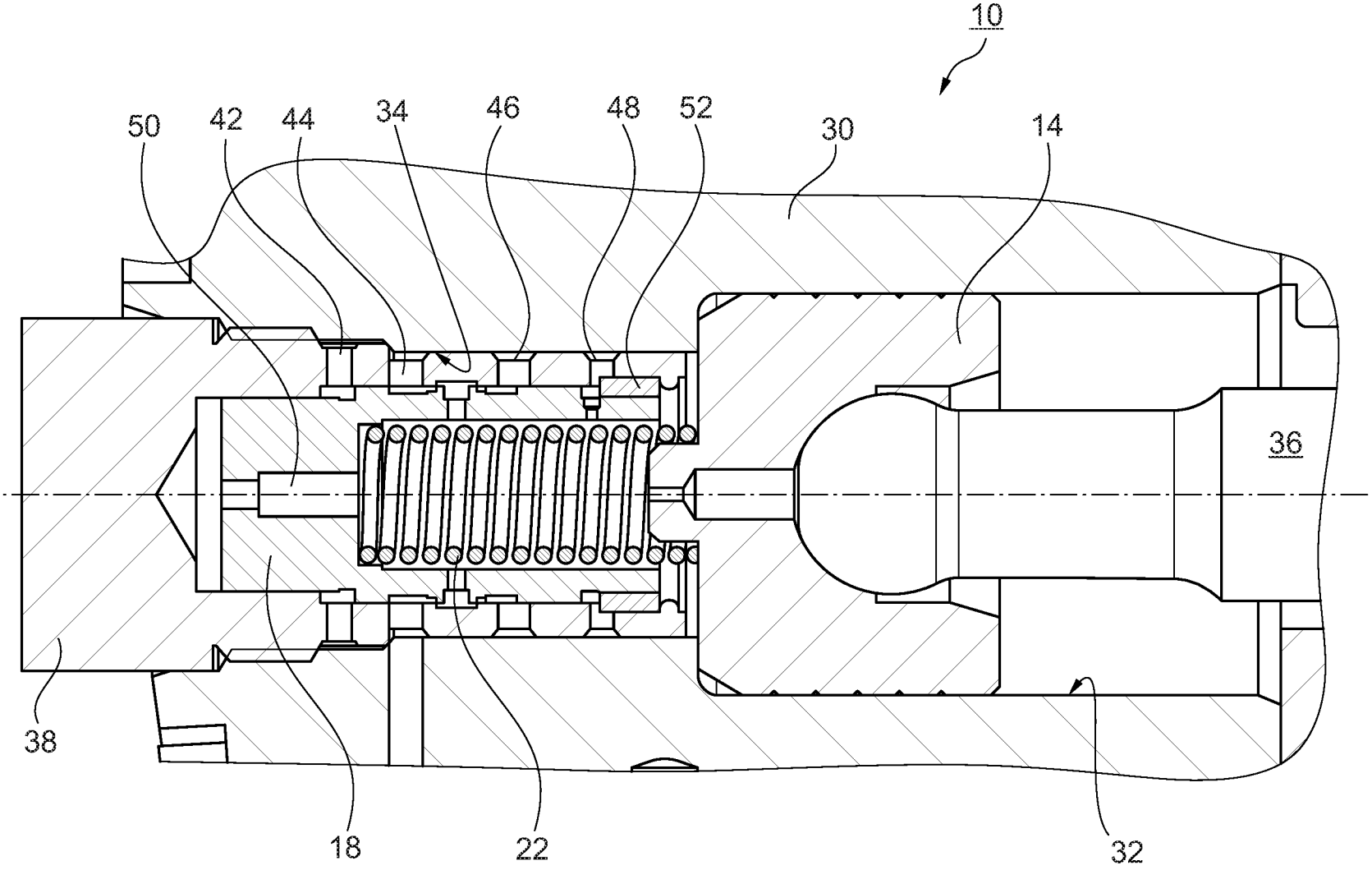
FIG. 3 shows the adjusting device according to FIG. 2 in another working position.

FIGS. 2 and 3 show a constructive exemplary embodiment for a volumetric flow regulator according to FIG. 1A. In a housing part 30 belonging to the otherwise axial piston machine an adjusting piston receiving bore 32 as well as a control piston receiving bore 34 are provided. As shown in FIG. 2, the diameter of the adjusting piston receiving bore 32 is greater than that of the control piston receiving bore 34 so that a shoulder is formed. In the adjusting piston receiving bore 32 the adjusting piston 14 is longitudinally shiftably seated, which is adjoined by an adjusting lever 36. With its end not shown here the adjusting lever 36 extends to the likewise swash plate of an axial piston machine. In the control piston receiving bore 34 a regulator housing 38 is inserted, in which a control piston 18 configured as a stepped piston is shiftably seated. The control piston 18 includes a pot-shaped recess 20. On the correspondingly formed bottom of the pot-shaped recess a feedback spring 22 is supported, which with its other end rests against the adjusting piston 14. The feedback spring 22 thus extends from the control piston receiving bore towards the adjusting piston receiving bore.

The free volumes of the control piston receiving bore 34 and the adjusting piston receiving bore 32 each are filled with hydraulic oil at adjusting pressure level. This hydraulic oil also fills the pot-shaped recess 20. In the lateral wall of the control piston 18, which encloses the pot-shaped recess 20, an adjusting pressure bore 40 is provided through which the hydraulic oil can enter. In the regulator housing 38 a control pressure bore 42, a regulating pressure bore 44, a high-pressure bore 46 and a tank bore 48 are provided, through each of which hydraulic oil flows in cooperation with the control piston 18 configured as a stepped piston to actuate the adjusting piston 14. As this mode of operation is known, no further description is needed here.

As compared to known constructions, this design also leads to a shortened design because instead of a proportional magnet adjoining the closure and adjusting unit 16 in the longitudinal extension an arbitrarily placeable pilot control unit is provided, which is connected to the aforementioned control pressure bore 40 arranged laterally in the regulator housing 38.

As shown here in the drawing, embodiments of the oil connections to the control piston 18 are guided through bores extending radially or obliquely radially through the regulator housing 38. To create a flow cross-section sufficient for an oil connection by providing for an installation space as small as possible with respect to the longitudinal extension of the regulator, a plurality of bores each with a smaller diameter are made instead of a single bore along an imaginary circle enclosing the shell surface of the regulator housing 38. With respect to the outside of the regulator housing 38, the bores of an oil connection are located on a groove base of a continuous outer radial groove correspondingly incorporated into the housing. The groove corresponds to the above-mentioned imaginary circle. By this measure, radial bores associated for an oil connection contribute to the intended oil flow of the hydraulic oil with the same effectiveness. For the illustrated exemplary embodiment these are the control pressure bores 42, the regulating pressure bore 44, the high-pressure bore 46 and the tank bore 48.

The arrangement of the adjusting pressure bore 40 in the wall of the control piston 18 represents a particularity of the present disclosure. Usually, the adjusting pressure bore 40 also is provided as a radial bore in the regulator housing 38. As a measure for limiting the overall length of the control piston 16 and thus for a compact construction of the regulator, the distances between the adjacent annular spaces that contain the bore are to be designed as small as possible. However, limits are obtained here for the minimum distances. The longitudinal portion of the control piston 18 on which the contours of control edges are applied requires a certain extension so as to have a clearly defined and reproducible dependence between the axial position of the control piston 18 and the pressure loss occurring across the control edge. In addition, adjacent volumes, in which desirably and due to the function greatly differing oil pressure levels, are at a certain distance from each other in order to avoid too much oil leakage here. A certain oil leakage always exists with correspondingly movable parts, which also is necessary as a lubrication for the movement of the control piston 18 in the interior of the regulator housing 38. When this leakage however becomes too high, an unnecessarily high power loss is obtained in the regulator. In the extreme case, too high a leakage also can lead to an unwanted influence on the position of the control piston 18. The leakage between adjacent annular spaces can be reduced for example by applying one or more radial grooves acting as split ring seals on the shell surface of the control piston. Such additional radial grooves however are not shown in FIG. 2 for reasons of simplification.

By shifting the adjusting pressure bore 40 into the outer wall of the control piston 18 the distance between the individual bores in the regulator housing 30 is increased so that even with a reduced overall length of the regulator the distance between the individual bores is comparatively larger. The entirely unwanted leakage on the outside of the regulator housing 18 thereby is suppressed sufficiently without an increased manufacturing effort being required for this purpose.

Via the adjusting pressure bore 40 the hydraulic oil enters into the free cavity of the control piston receiving bore 34 with the desired adjusting pressure via the existing fluid connection also into the free regions of the adjusting piston receiving bore 32. As shown in FIG. 2, a bore 50 penetrating the remaining region of the control piston 18 is provided from the blind hole bottom of the control piston 18. Thereby, an oil connection is created so that the existing hydraulic pressure on both sides applies the adjusting pressure on the control piston 18. Desired compensation is used to avoid an unwanted shift in the position of the control piston 18 by the adjusting pressure created by both cross-sectional surfaces of the control piston 18 on which the adjusting pressure acting in opposite directions is applied is of the same size. In the exemplary embodiment shown here, this compensation is created in that the control piston 18 formed as a stepped piston is inserted into the regulator housing 38 via a mounting ring 52.

In the representation of FIG. 2 the adjusting piston 14 and hence the adjoining adjusting lever 36 is maximally deflected. In FIG. 3 the adjusting device of FIG. 2 is shown in another position. Here, the adjusting piston 14 and hence the adjoining adjusting lever 36 is fully retracted. This representation clearly shows that the feedback spring 22 in the contracted condition is almost completely received in the pot-shaped recess 20 of the control piston 18. By this construction a minimum overall length is achieved.

Figure 4:
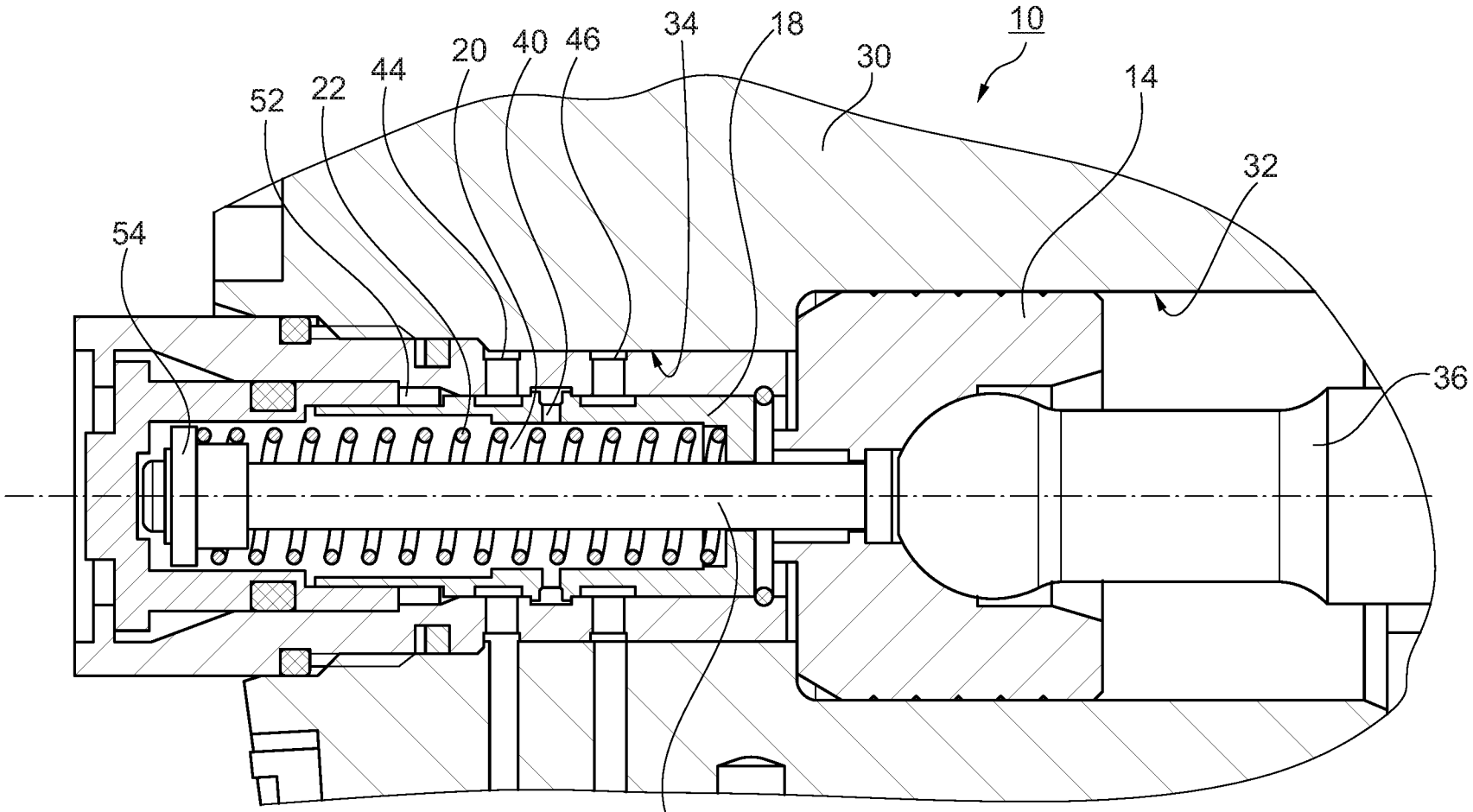
FIG. 4 shows a partly sectional representation through an adjusting device according to a second embodiment of the present disclosure.

FIG. 4 shows an adjusting device 10 in a constructive configuration that corresponds to the schematic representation according to FIG. 1B. Here, a power regulator 12' is integrated. Components are configured in the same way as in FIGS. 2 and 3. In a housing 30 of a axial piston machine, an adjusting piston receiving bore 32 and a control piston receiving bore 34 are provided here as well. In the adjusting piston receiving bore 32 an adjusting piston 14 with adjoining adjusting lever 36 also is inserted here again. Here, the adjusting piston 14 is shown in the fully retracted position. In this embodiment, the adjusting lever 36 is connected to the feedback spring 22 via a tappet 28 at whose end a spring plate 54 is arranged. The opposite side of the feedback spring 22 rests against the bottom of the control piston 18 which here likewise is provided with a pot-shaped recess 20. Thus, in this design variant the feedback spring 22 also dips into the pot-shaped recess 20 of the control piston 18. Through the lateral wall of the control piston 18 the adjusting pressure bore 40 also extends in the embodiment shown here, whereby the same advantages are obtained as in the embodiment described above. Furthermore, a tank bore 48, a regulating pressure bore 44 and a high-pressure bore 46 are provided.

The control piston receiving bore 34 and the adjusting piston receiving bore 32 are aligned coaxially to each other in the embodiments of FIGS. 2 and 3 and in the embodiment of FIG. 4. As a result, the control piston 18 and the adjusting piston 14 also extend coaxially to each other. This design variant however has the disadvantage that the adjusting piston 14 connected to the swash plate of a axial piston machine 100 via an adjusting lever 36 compensates a transverse force introduced via the adjusting lever 36, which leads to a non-uniform action on the adjusting piston 14 in the adjusting piston receiving bore 32.

This problem is solved by the constructive configuration of the adjusting devices according to FIGS. 5 and 6, 7 and 8, respectively.

Figure 5:
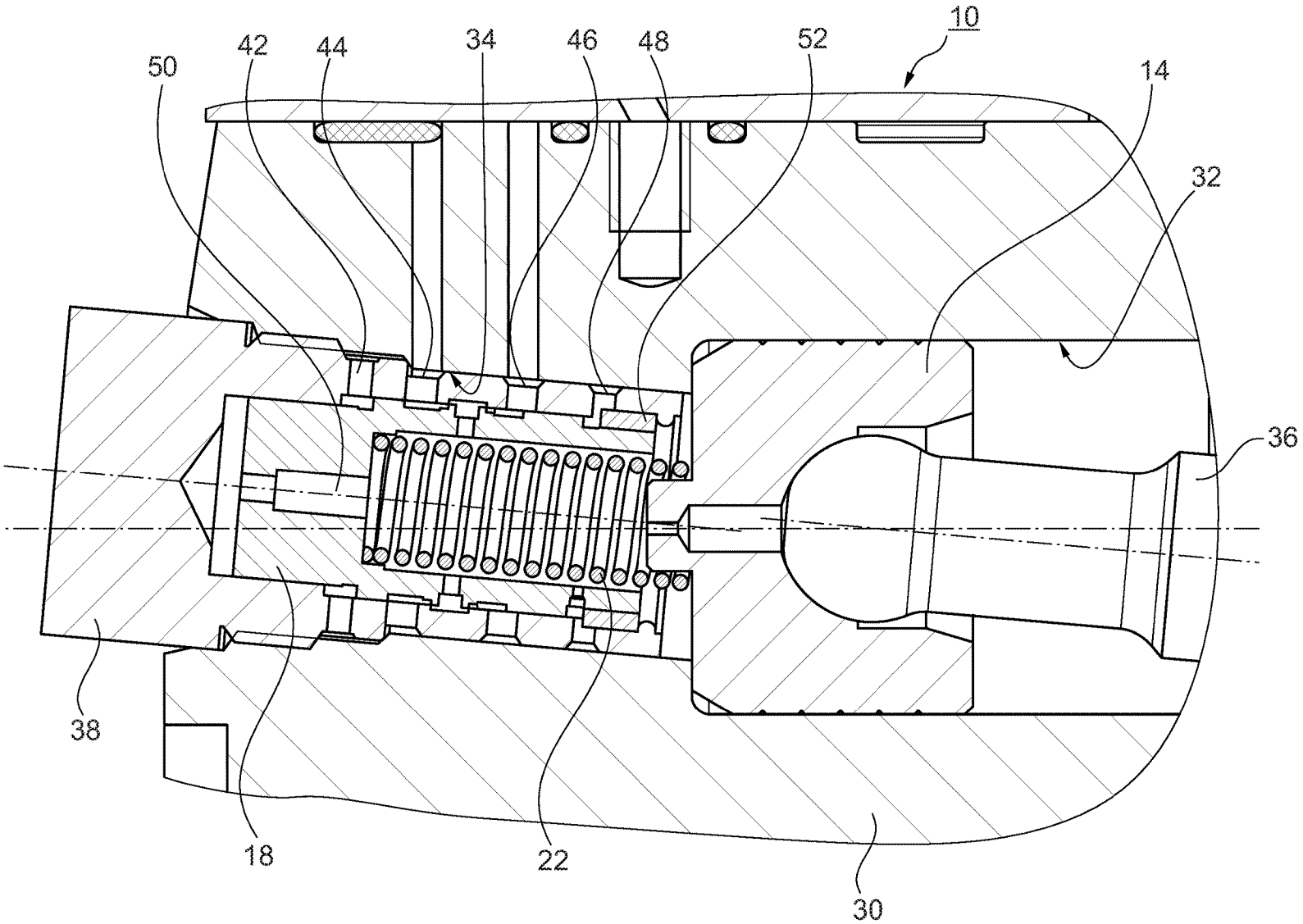
FIG. 5 shows a partly sectional representation of an adjusting device according to a third embodiment of the present disclosure.
Figure 6:
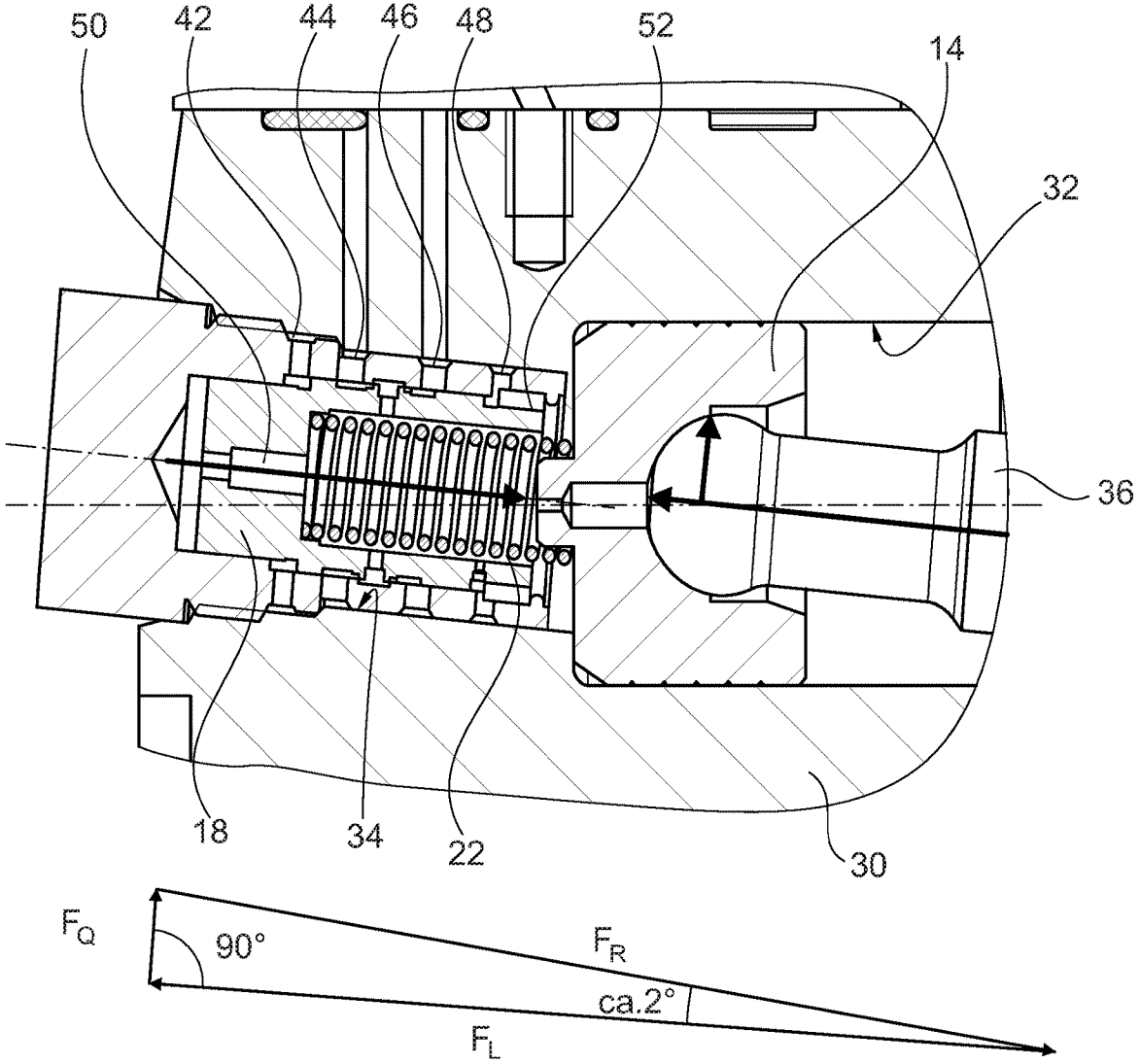
FIG. 6 shows the embodiment of FIG. 5 with an explanation of the acting forces.

FIG. 5 represents an adjusting device 10 corresponding to the construction of the adjusting device according to FIG. 3, wherein the adjusting piston 14 here likewise is in the same position as in FIG. 3. However, in this design variant the adjusting piston receiving bore 32 is angled by an angle with respect to the control piston receiving bore 34. The force compensation of the transverse force applied via the adjusting lever 36, which is achieved thereby, can be illustrated with reference to the forces depicted in FIG. 6. The equilibrium of forces at the adjusting piston 14 is shown there, wherein FL designates the longitudinal component of the adjusting force, FQ designates the transverse component of the adjusting force, and FR designates the restoring force of the piston. In the exemplary embodiment shown here, a typical angle of about 2° is indicated, which leads to an obtuse angle of 178°, at which the respective middle axes of the control piston receiving bore 34 on the one hand and the adjusting piston receiving bore 32 on the other hand are aligned relative to each other. This only is an exemplary indication of an angle. In accordance with the present disclosure, an even greater or smaller obtuse angle can also be employed here.

Figure 8:
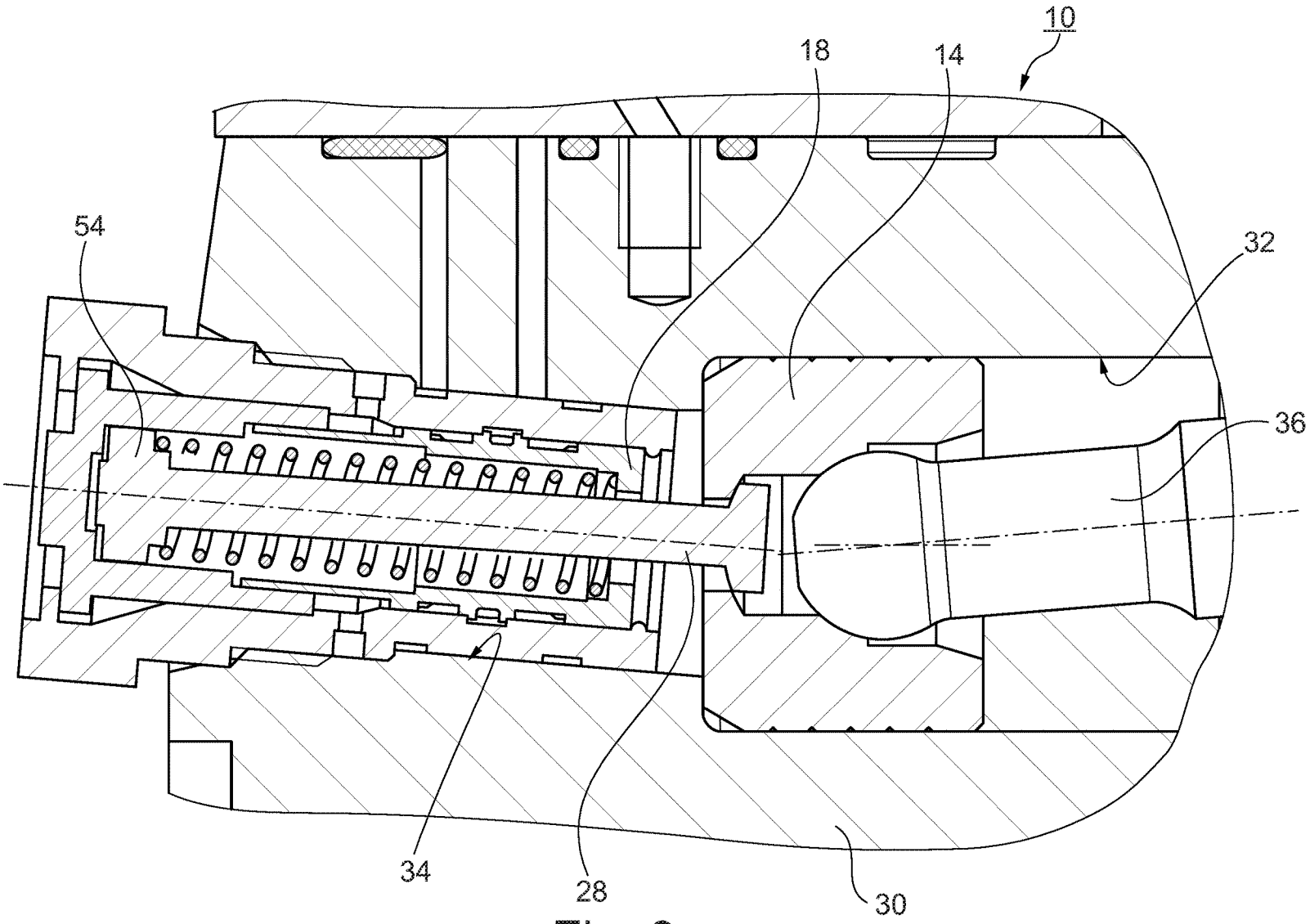
FIG. 8 shows a sectional representation through a part of the adjusting device according to a fifth embodiment of the present disclosure.

FIG. 8 likewise shows an angled design variant of an adjusting device, here however as a power regulator 12' as shown in FIG. 4. According to this representation, the control piston receiving bore 34 likewise is angled with respect to the adjusting piston receiving bore 32. In this embodiment, the tappet 28 is guided obliquely into the adjusting piston 14.

Figure 7:
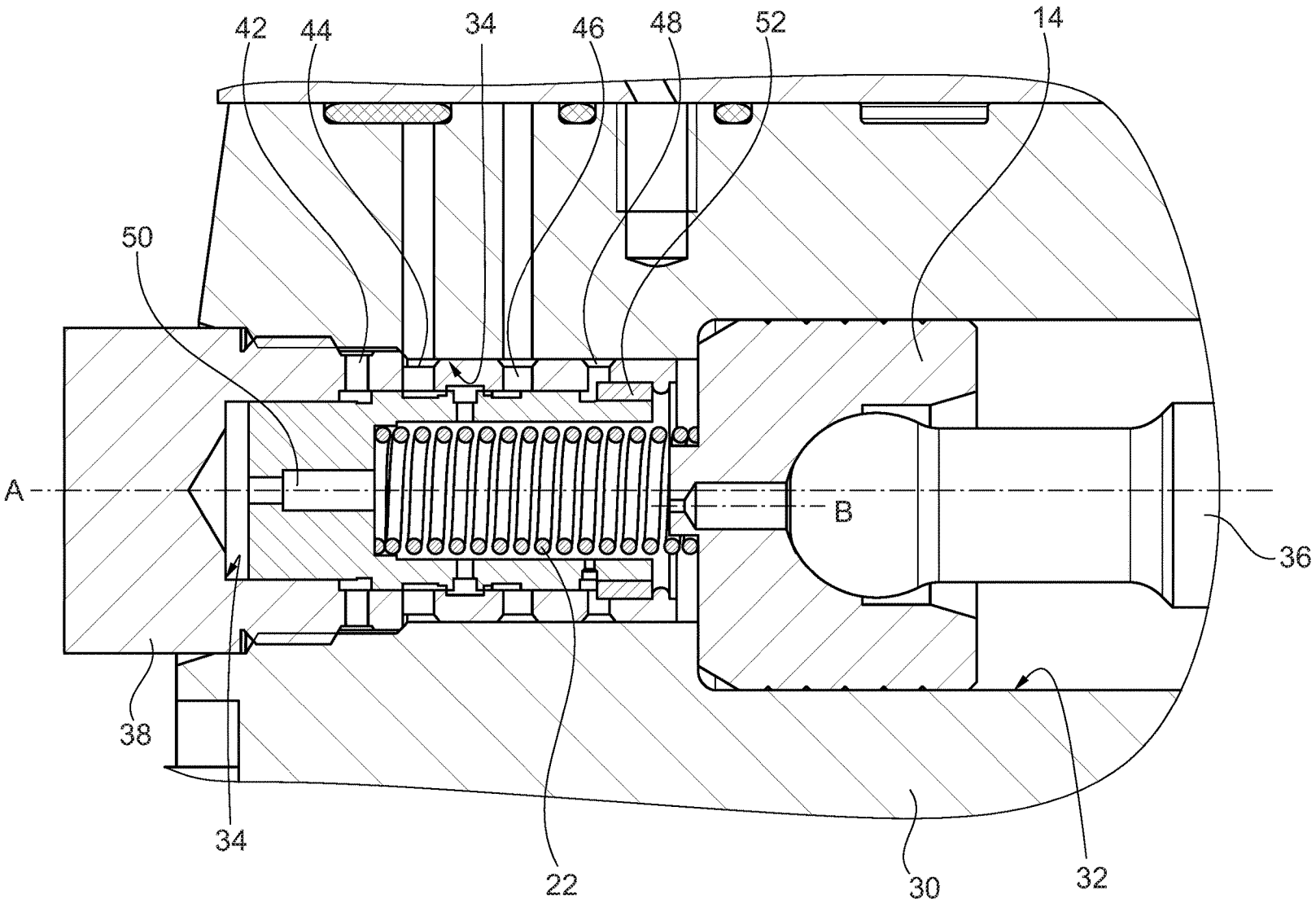
FIG. 7 shows a sectional representation through a part of an adjusting device according to a fourth embodiment of the present disclosure.

In the design variant according to FIG. 7, a compensation of the transverse force is achieved in that the axis A of the control piston receiving bore 34 and the axis B of the adjusting piston receiving bore 32 are shifted parallel to each other, i.e. offset. With a corresponding adjustment of the offset, the transverse component of the adjusting force, which is applied by the adjusting lever 36, also can be compensated thereby.

Figure 9:
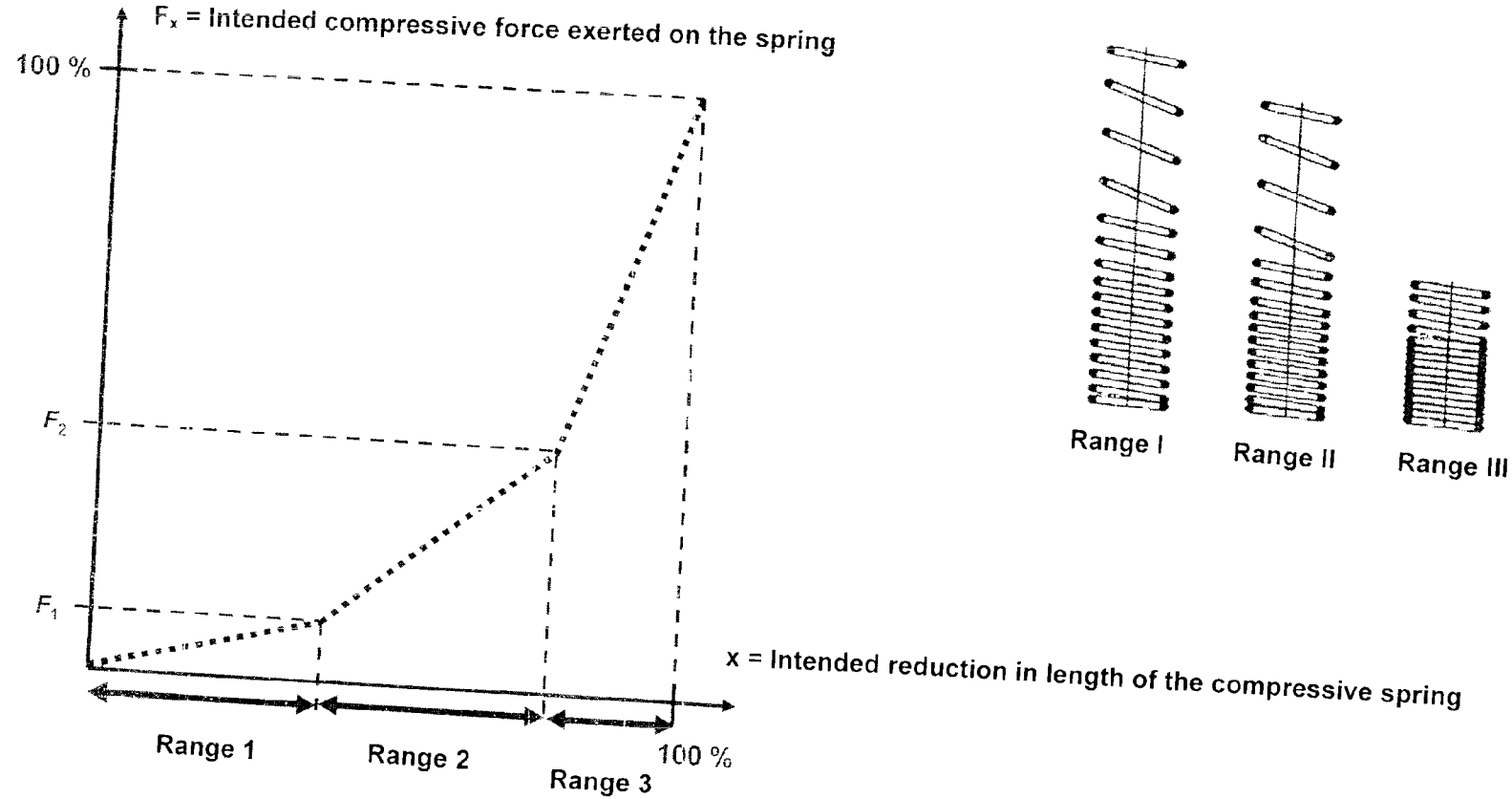
FIG. 9 shows a diagram representation of the spring characteristic of a feedback spring used according to the present disclosure.

In all design variants the feedback spring 22 can be formed as a spring with a non-linear spring characteristic, i.e. here with a progressively rising force-spring travel characteristic curve, in particular in the design variants of the adjusting device that include a power regulator 12'. In FIG. 9 the corresponding spring characteristic curve is shown. There, the compressive force exerted on the spring provided there is plotted over the provided reduction in length of the compressive spring. The characteristic curve shown here has an exemplary character. One common feature of the springs depicted on the right side in three different contraction widths and of that spring which has the characteristic map shown on the left side is the presence of three areas in which the spring has different spring stiffnesses. This is revealed in the characteristic map due to the presence of three straight portions with different slopes. With reference to the illustrated spring this is shown best in the first representation in which the lowest contraction exists. The adjacent spring windings here have a distinctly larger distance. In the middle length portion of the spring a distinctly smaller distance of adjacent spring windings can be seen and in the lower region this distance is even smaller.

When viewing a contraction of such a spring the following is to be observed. Proceeding from a very small and rising application of force, all spring windings contribute to a length contraction in a region I. The spring windings between which the smallest distance is present without the presence of a contraction force and a contraction force present within the region I contact each other after the exceedance of a certain force. As soon as this has occurred, no contribution is made in these windings to a further reduction of the spring length in connection with a further increase of the contraction force. From an exceedance of a yet higher threshold value an additionally continuously increasing contraction force only leads to a compression of those spring windings which still have a distance from their adjacent winding.

In accordance with the present disclosure it is also possible to use coil springs that have another number of contraction areas or due to other embodiments have a non-linear force-spring travel characteristic curve, for example due to having a cone-shaped contour etc. Instead of coil springs other springs with a corresponding spring characteristic can also be used. For example, combinations with a coil spring are conceivable that is supported by a disk spring at one or both spring ends or is supported on a stack of disk springs. These disk springs can also have different stiffnesses.

Figure 10:
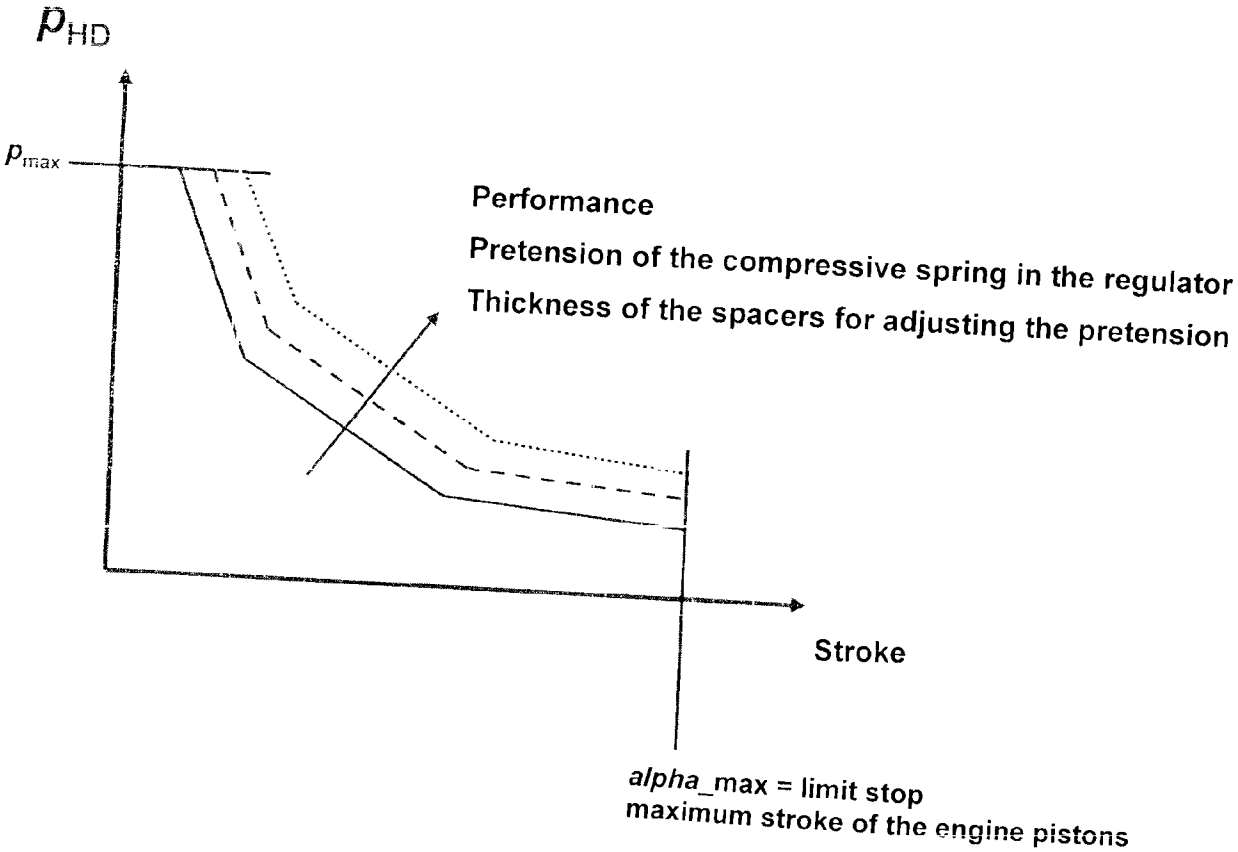
FIG. 10. shows a diagram with the family of characteristic curves for a power regulator according to the present disclosure.

By using a corresponding non-linear feedback spring, a characteristic curve that approaches the course of a hyperbola pHD*Q=constant at a constant rotational speed can be achieved in a power regulator as it is shown for example in FIG. 4 or 8. This means that the product of the stroke of the engine pistons and the pressure level at the high-pressure outlet of the axial piston machine is constant. In the aforementioned formula pHD designates the high-pressure level at the high-pressure outlet of the hydraulic pump or at the inlet of the hydraulic motor. Q is the discharged volumetric flow of the hydraulic pump or the received volumetric flow of the hydraulic motor, i.e. here of the axial piston machine. By adjusting different pretensions of the non-linear feedback spring, a family of characteristic curves indicated corresponding to the representation of FIG. 10 is obtained. A limit here on the one side is given at the maximum high pressure and on the other side at the maximum stroke of the engine pistons, i.e. the limit stop.

The invention claimed is:

1. An adjusting device for adjusting a swash plate of an axial piston machine comprising:

an adjusting piston, a first end of the adjusting piston connected to the swash plate of the axial piston machine via an adjusting lever, a second end of the adjusting piston positioned opposite the first end and adjacent a control piston, a regulator which adjusts an adjusting pressure acting on the adjusting piston in dependence on a control force acting on the control piston of the regulator, and a pot-shaped recess forming a hydraulic control volume and housing a feedback spring, the pot-shaped recess formed within an interior of the control piston and extending from a first end of the control piston to a second end of the control piston opposite the first end, the first end of the control piston adjacent the adjusting piston, the pot-shaped recess being hollow and having an open end to form a hydraulic control volume within the control piston extending from the second end of the control piston to a the second end of the adjusting piston, and the feedback spring extending through the hydraulic control volume from the second end of the control piston to the adjusting piston.

2. The adjusting device according to claim 1, wherein the control piston is arranged in a control piston receiving bore and that the adjusting piston is arranged in an adjusting piston receiving bore such that the control piston receiving bore and the adjusting piston receiving bore merge into each other, wherein the adjusting piston receiving bore has a larger diameter than the control piston receiving bore.

3. The adjusting device according to claim 1, wherein a control piston receiving bore and an adjusting piston receiving bore are aligned coaxially to each other.

4. The adjusting device according to claim 1, wherein an entire free volume of a control piston receiving bore and the pot-shaped recess are filled with hydraulic oil at adjusting pressure level, a wall of the control piston includes at least one adjusting pressure bore and at least one axial bore, the at least one axial bore oriented towards a side of the control piston opposite the pot-shaped recess and is fluidly connected to an adjusting cylinder receiving the adjusting piston.

5. The adjusting device according to claim 1, wherein the control piston is stepped on an outside surface and is mounted in a control piston receiving bore via a ring.

6. The adjusting device according to claim 1, wherein the regulator is configured as a volumetric flow regulator or as a power regulator.

7. The adjusting device according to claim 1, wherein the feedback spring has a non-linear spring characteristic with a progressively rising force-spring travel characteristic curve.

8. The adjusting device according to claim 7, wherein the feedback spring is formed in one part.

9. An adjusting device for adjusting a swash plate of an axial piston machine comprising:

an adjusting piston, a first end of the adjusting piston connected to the swash plate of the axial piston machine via an adjusting lever, a second end of the adjusting piston positioned opposite the first end and adjacent a control piston, a regulator adjusts an adjusting pressure acting on the adjusting piston in dependence on a control force acting on the control piston of the regulator, a feedback spring connecting the adjusting piston and the control piston, and a pot-shaped recess forming a hydraulic control volume and housing the feedback spring, the pot-shaped recess comprising a bottom and a lateral wall extending along a central axis of the control piston, the pot-shaped recess being hollow and having an open end to form a hydraulic control volume within the control piston, and the feedback spring extending through the hydraulic control volume from the bottom of the pot-shaped recess, along the lateral wall, to the adjusting piston, wherein the second end of the adjusting piston comprises an adjusting piston face shaped with an extension which receives the feedback spring, and the extension extends into the pot-shaped recess in a first position.

10. The adjusting device of claim 9, wherein the control piston is arranged in a control piston receiving bore and that the adjusting piston is arranged in an adjusting piston receiving bore such that the control piston receiving bore and the adjusting piston receiving bore merge into each other, wherein the adjusting piston receiving bore has a larger diameter than the control piston receiving bore.

11. The adjusting device of claim 9, wherein a control piston receiving bore and an adjusting piston receiving bore are aligned coaxially to each other.

12. A method of adjusting a swash plate of an axial piston machine comprising:

connecting a first end of an adjusting piston to the swash plate of the axial piston machine via an adjusting lever such that a second end of the adjusting piston is positioned opposite the first end and adjacent a control piston, adjusting pressure acting on the adjusting piston via a regulator in dependence on a control force acting on the control piston of the regulator, and connecting the adjusting piston and the control piston via a feedback spring such that the feedback spring extends through a pot-shaped recess, the pot-shaped recess formed within a hollow interior of the control piston and having an open end to form a hydraulic control volume within the control piston, and the feedback spring extending through the hydraulic control volume from the adjusting piston to a second end of the control piston opposite the adjusting piston.

13. The method of claim 12, wherein a control piston receiving bore and a adjusting piston receiving bore are aligned coaxially to each other.

14. The adjusting device of claim 1, wherein the pot-shaped recess is filled by hydraulic oil and the feedback spring, an adjusting pressure bore positioned within a lateral wall of the control piston between the first end and the second end, and hydraulic oil entering the pot-shaped recess through the adjusting pressure bore.

15. The adjusting device of claim 9, wherein the pot-shaped recess is filled by hydraulic oil and the feedback spring, an adjusting pressure bore positioned within the lateral wall of the control piston between the bottom and the second end, and hydraulic oil entering the pot-shaped recess through the adjusting pressure bore.

16. The adjusting device of claim 1, wherein the adjusting piston does not have a cavity or form part of the control volume.

17. The adjusting device of claim 1, wherein the feedback spring is the only structure within the control piston.

18. The adjusting device of claim 1, wherein the second end of the adjusting piston comprises an adjusting piston face is shaped with an extension which receives the feedback spring, and the extension extends into the pot-shaped recess in a first position.

* * * * *